US006579368B1

(12) United States Patent
Kohl et al.

(10) Patent No.: US 6,579,368 B1
(45) Date of Patent: Jun. 17, 2003

(54) APPARATUS FOR THE APPLICATION OF A LIQUID OR PASTY MEDIUM TO A MOVING FIBER WEB

(75) Inventors: Bernhard Kohl, Heidenheim (DE); Stefan Reich, Heidenheim (DE); Benjamin Méndez-Gallon, Königsbronn (DE); Martin Kustermann, Heidenheim (DE); Manfred Ueberschär, Gerstetten (DE); Christioph Henninger, Heidenheim (DE); Rüdiger Kurtz, Heidenheim (DE); Martin Tietz, Heidenheim (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 124 days.

(21) Appl. No.: 09/621,784

(22) Filed: Jul. 21, 2000

(30) Foreign Application Priority Data

Jul. 22, 1999 (DE) ..... 199 34 441

(51) Int. Cl.[7] ..... B05C 3/02

(52) U.S. Cl. ..... 118/414; 118/262; 118/413; 118/261

(58) Field of Search ..... 118/413, 414, 118/261, 262, 419

(56) References Cited

U.S. PATENT DOCUMENTS

| | | | | |
|---|---|---|---|---|
| 3,418,790 | A | * | 12/1968 | Phelps et al. |
| 4,245,582 | A | * | 1/1981 | Alheid et al. |
| 4,250,211 | A | * | 2/1981 | Damrau et al. |
| 4,534,309 | A | * | 8/1985 | Damrau et al. |
| 4,757,782 | A | * | 7/1988 | Pullinen |
| 4,839,201 | A | * | 6/1989 | Rantanen et al. |
| 5,599,392 | A | * | 2/1997 | Liang et al. |
| 5,599,393 | A | * | 2/1997 | Elvidge et al. |
| 5,720,816 | A | | 2/1998 | Li et al. |
| 5,746,833 | A | * | 5/1998 | Gerhardt |
| 5,858,090 | A | * | 1/1999 | Gottwald |
| 6,004,394 | A | | 12/1999 | Gottwald |
| 6,149,726 | A | * | 11/2000 | Ueberschar |

FOREIGN PATENT DOCUMENTS

| | | | |
|---|---|---|---|
| DE | 29 13 053 A1 | 10/1980 | ..... B05C/5/02 |
| DE | 84 14 904 U1 | 2/1986 | ..... B05C/5/02 |
| DE | 197 43 520 A1 | 4/1999 | ..... B05C/11/04 |
| EP | 0 319 503 B1 | 5/1993 | ..... B05D/1/00 |

OTHER PUBLICATIONS

English Abstract of Japanese Patent Document No. 10216600 A.

* cited by examiner

*Primary Examiner*—Brenda A. Lamb
(74) *Attorney, Agent, or Firm*—Taylor & Aust, P.C.

(57) ABSTRACT

An application apparatus is for applying a liquid or pasty medium to a moving base. The moving base is a surface of a material web in a case of direct application and a surface of a transfer element for transferring the medium to the material web in a case of indirect application, the material web being one of paper and cardboard. The application apparatus has an inlet side and an outlet side with respect to a direction of movement of the moving base. The application apparatus includes a carrying beam; an essentially rigid supporting unit provided on the carrying beam; a sealing doctor device positioned at the inlet side of the application apparatus, the sealing doctor device being fixedly attached to the supporting unit; and a metering doctor device positioned at the outlet side of the application apparatus, the metering doctor device being fixedly attached to the supporting unit. The sealing doctor device and the metering doctor device define an application chamber therebetween.

30 Claims, 3 Drawing Sheets

APPARATUS FOR THE APPLICATION OF A LIQUID OR PASTY MEDIUM TO A MOVING FIBER WEB

BACKGROUND OF THE INVENTION

1. Field of the invention.

The present invention relates to an apparatus for the application of a liquid or pasty medium to a moving base.

2. Description of the related art.

A base for the application of a liquid or pasty medium, in the case of direct application, is the surface of a fiber material web, in particular of paper or cardboard. Alternatively, in the case of indirect application, the surface of a transfer element, for example a transfer roll, transfers the medium to the material web, the medium being brought into contact with the moving base in an application chamber. The application chamber is bounded on the inlet side by a metering doctor device, with respect to the running direction of the base with the two doctor devices being arranged on a carrying beam.

An application apparatus of this type is disclosed, for example, by DE 44 44 779 A1. In the case of this application apparatus, the metering doctor device bounding the application chamber on the outlet side is designed as a roll doctor, whose doctor bed is fixed directly on the carrying beam via a holding blade. In order to influence the setting of the metering doctor against the base in accordance with the operation, an actuating device is provided. On the inlet side, the application chamber is likewise bounded by a roll doctor device, the doctor bed accommodating the doctor rod being fixed to a carrier beam by a spring-loaded holder. Specific influence of the setting of the sealing doctor rod against the base is not possible during the continuous operation of the application apparatus. Because of the above-described holding of the doctor devices by flexible blades, the distance between the two roll doctors can vary slightly, which entails a corresponding variation in the volume of the application chamber. Consequently, the medium has to be fed to the application chamber with a high excess in order to ensure in the application chamber pressure relationships which permit a reproducible coat weight of the medium leaving the application chamber of the application layer to be obtained.

The same is also true of the application apparatus disclosed by EP 0 319 503 B1 (see, in particular, FIG. 10) and the application apparatus disclosed by DE 84 14 904 U1. The two last-mentioned application apparatuses additionally have the disadvantage that the doctor bed or the blade holder of at least one of the two doctor devices is also used at the same time for bounding the feed line for feeding the medium into the application chamber. On the one hand, this creates sealing problems and, on the other hand, when the setting of the respective doctor device against the moving base is changed, it also inevitably leads to an influence being exerted on the quantity of medium fed to the application chamber per unit time (medium feed rate). Such an influence further has a detrimental effect on the pressure relationships prevailing in the application chamber.

In addition, DE 196 52 289 A1 discloses an application apparatus of the generic type in which both the sealing doctor device and the metering doctor device are a doctor rod. The two doctor rods are accommodated in a common doctor bed, in which the feed line for the medium is also located. The feed line is fixed to the carrying beam via an elastic blade. Furthermore, two actuating devices are provided, one of which acts on the doctor bed in the region of the sealing doctor rod and the other acts in the region of the metering doctor rod. Although, in the case of this application apparatus, on the one hand the size of the application chamber and on the other hand the quantity of medium fed per unit time depend to a lesser extend on the setting of the two doctor devices against the base. The disadvantage with this arrangement is that a change in the influence of one of the two actuating devices on the doctor bed always leads to an influence being exerted on the setting of the respective other doctor device against the moving base, so that coat weight and excess quantity cannot be adjusted independently of each other.

For completeness, reference should further be made to DE 29 13 053 A1 in relation to the prior art.

SUMMARY OF THE INVENTION

By contrast, the present invention specifies an application apparatus of the generic type which, while maintaining the capability of independently exerting an influence on the setting of the two doctor devices against the moving base, makes it possible to obtain defined volume and/or pressure relationships in the application chamber.

According to the invention, an application apparatus of the type mentioned at the beginning uses two doctor devices which are fixed to an essentially rigid supporting unit provided on the carrying beam. On account of the essentially rigid construction of the supporting unit, the doctor devices are kept at a predetermined distance from each other in the running direction of the base. On account of the rigidity[]of the supporting unit, this predetermined distance is, in this case, essentially independent of the quantity of medium fed to the application chamber per unit time, the pressure prevailing in the application chamber and the respective setting of the two doctor devices against the base. Furthermore, the essentially rigid supporting unit ensures a defined arrangement of the two doctor devices in the transverse direction of the base as well. Overall, in this way, the conditions prevailing in the application chamber and medium feed, in particular volume and/or pressure, can be reproduced so reliably that the excess quantity which leaves the application chamber past the sealing doctor device can be reduced considerably, as compared with the prior art and, consequently, a high-quality application layer can be obtained. As a result of reducing the excess quantity, the circulated quantity of the medium can be reduced, and thus the delivery pump assigned to the medium feed can be designed to have a correspondingly lower performance and therefore to be more cost-effective in procurement and operation.

Moreover, the essentially rigid supporting unit permits the two doctor devices to be fixed to it in such a way that their settings against the moving base can be influenced independently of each other, without a change to the setting of one of the two doctor devices which would otherwise result in back-effects on the setting of the respective other doctor devices. The resulting decoupling of the two doctor devices simplifies their driving and thus increases their adjustment potential. This can be achieved, for example, by making it possible for the two doctor devices to be fixed to the supporting unit independently of each other.

In a development of the invention, it is proposed that the supporting unit include feed channels which feed the medium from a distribution pipe to the application chamber. In this way, the influence exerted on the quantity of medium fed to the application chamber per unit time can be decoupled largely, if not completely, from the influence exerted on the setting of the two doctor devices against the base. For example, the feed channels can be constructed as through holes, bores or the like in the supporting unit. Alternatively, the feed channels could also run through at least one of the doctor devices, for example through a doctor bed of a roll doctor device. In particular in the case of an application apparatus with a relatively low operating width and/or an application apparatus for applying medium at a relatively low coat weight, it may be advantageous for the distribution pipe also to be formed in the supporting unit. This simplifies, at least, the construction of the carrying beam.

In order to be able to achieve the most uniform possible distribution of the medium emerging from the feed channels in the transverse direction of the base, that is to say over the operating width, it is proposed that at least one baffle plate be arranged on the supporting unit in the area of the outlet openings of the feed channels into the application chamber. This baffle plate prevents the medium emerging from the feed channels from immediately contacting with the base, and thus ensures the deflection of the medium both in the running direction and in the transverse direction of the base. Here, the movement components in the transverse direction ensure uniform distribution of the medium over the operating width, while the movement components in the running direction prevent the production of transverse vortices which have a detrimental influence on the application result.

The distance between the baffle plate and the outlet openings and/or the shape of the baffle plate can be chosen on the basis of the operating conditions with regard to exerting a favorable influence on the resulting application. The distance between the baffle plate and the outlet openings can, in this case, be changed, for example, by fixing the baffle plate detachably to the supporting unit and interposing appropriate spacers.

A simple and nevertheless precise type of attachment of the doctor devices to the supporting unit can be provided, for example, by fixing the metering doctor device and/or the sealing doctor device to the supporting unit in a form-fitting manner.

For attachment to the supporting unit, at least one of the two doctor devices can be assigned at least one force appliance, which is preferably supported on the supporting unit or on a part connected thereto. Furthermore, at least one of the two doctor devices, preferably both thereof, can respectively be assigned at least one force appliance for exerting an influence on its setting against the moving base. This setting force appliance can also be supported on the supporting unit or on a part connected thereto.

The sealing doctor device mainly has the function of sealing off the application chamber against the ingress of air. That is to say, in particular, to keep away from the application chamber an air boundary layer carried along at the surface of the moving base. Thus, with regard to the simplest possible design of the control unit of the application apparatus according to the invention, it is sufficient for the setting of the sealing doctor device against the moving base to be capable of being adjusted without closed-loop control. On the other hand, since the metering doctor device is used to set the magnitude of the coat weight of the medium applied to the moving base, it is advantageous if the setting of the metering doctor device against the moving base can be controlled.

Both the at least one fixing force appliance and the at least one setting force appliance can be force appliances which can be operated hydraulically and/or pneumatically and/or hydropneumatically and/or electrically and/or magnetically and/or by electric motor and/or electrochemically.

With regard to the ability to change the transverse profile of the layer of medium applied to the base, it is further proposed that at least one of doctor devices, preferably at least the metering doctor device, be assigned a number of force appliances which are arranged adjacently in the transverse direction of the base and which can be driven and/or controlled independently of one another, and thus permit an influence to be exerted section by section on the setting of the doctor device against the base.

In order to prevent contamination of the force appliances and thus be able to ensure their serviceability, in a development of the invention it is proposed that a flat covering element be provided between at least one of the doctor devices and at least one of the force appliances assigned to this doctor device. The use of a covering element of this type is advantageous, in particular in the area of the sealing doctor device, since in order to avoid the ingress of air into the application chamber, it is quite common to feed the medium to the application chamber in excess and to permit excess medium to emerge from the application chamber past the sealing doctor device in the direction opposite to the running direction of the base.

In a manner known per se, the metering doctor device and/or the sealing doctor device may include a doctor rod. In this case, the metering doctor rod and/or the sealing doctor rod can be driven in rotation. In particular, a metering doctor rod rotating in the direction opposite to the running direction of the base can improve the quality of the resulting application.

In a development of the invention, it is proposed that the diameter of the metering doctor rod be alternately equal to or smaller than the diameter of the sealing doctor rod.

Furthermore, the two doctor rods can either have a smooth or a profiled surface; however, in order to achieve a good sealing action, it is advantageous if at least the sealing doctor rod has a profiled surface.

In principle, the supporting unit can be provided as an integral part of the carrying beam. If, however, the supporting unit is a unit constructed separately from the carrying beam, then the carrying beam ensures the stability of the application apparatus with regard to bending effects caused by gravity. Thus, the supporting unit itself does not need to perform any stabilization function and can therefore be constructed as a part which has a relatively light weight and therefore be simple to handle. The supporting units can be fixed to the carrying beam at a relatively low number of fixing points, which simplifies the machining of the carrying beam.

Furthermore, the low number of fixing points of the supporting unit on the carrying beam permits the rapid changing of the supporting unit and the doctor devices arranged on it. Thus, during the continuous operation of the application apparatus, using a first supporting unit with doctor devices arranged thereon, a second supporting unit with unworn doctor devices can be readied at an equipment workplace and then, when the application apparatus is at a standstill, can be substituted relatively quickly and simply for the first supporting unit. Using such a changeover procedure, the unproductive times of the application apparatus can be reduced.

If the loading of the sealing doctor device can be controlled indirectly or directly on the basis of the pressure prevailing in the application chamber, this helps to prevent the production of an undesired excess of pressure in the application chamber. Furthermore, it is possible to influence the coat weight of the medium leaving the application chamber as an application layer by the loading of the metering doctor device and sealing doctor device being varied relative to each other.

In addition or as an alternative, it is moreover possible for the metering doctor device and/or the sealing doctor device to be a doctor blade.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate multiple preferred embodiments of the invention and such exemplifications are not to be construed as limiting the scope of the invention in any manner.

DETAILED DESCRIPTION OF THE INVENTION

Figure 1:
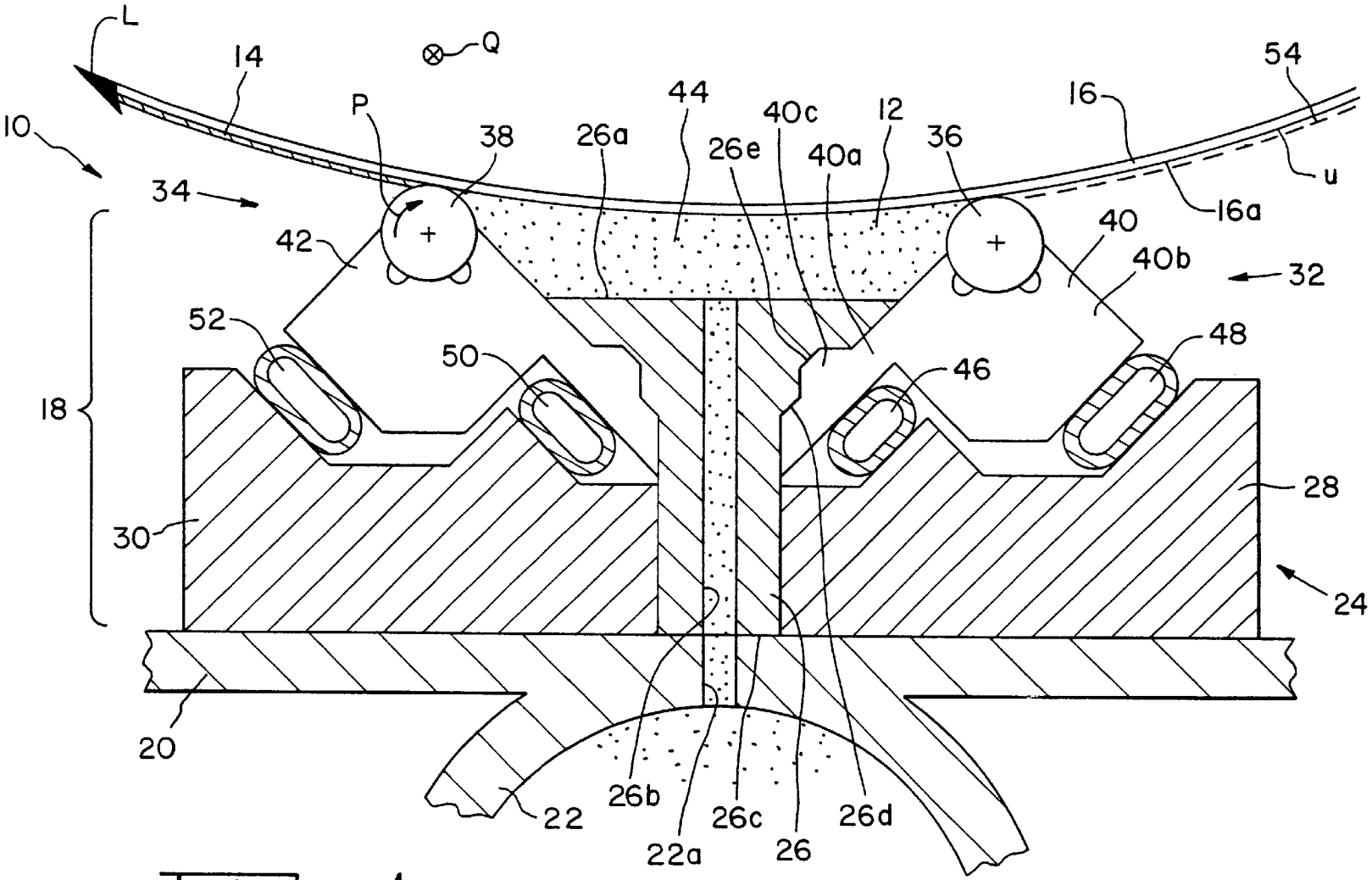
FIG. 1 is a schematic illustration of a section, made at right angles to the transverse direction of the moving base, of a first embodiment of an application apparatus according to the invention.

In FIG. 1, application apparatus 10 is used to apply a medium 12 as an application layer 14 to a base U moving in the direction of arrow L. Base U can, in the case of direct application, be surface 16*a* of a material web 16, in particular a paper or cardboard web, or can, in the case of indirect application, be the surface of a mating element, for example a mating roll, from which application layer 14 is then transferred to material web 16.

Application apparatus 10 includes an application subassembly 18, which is preferably detachably fixed to a carrying beam 20. Carrying beam 20 is designed in a manner known per se as a solid component. Carrying beam 20 thereby serves to prevent bending, caused by gravity, of entire application apparatus 10 over the operating width of material web 16. In the embodiment illustrated, distribution pipe 22, running in transverse direction Q of material web 16, is also arranged in carrying beam 20 and is used to feed and distribute medium 12 uniformly over the operating width of material web 16. The construction and arrangement of such distribution pipes 22 are known in the prior art and will therefore likewise not be described in detail here.

Application subassembly 18 includes a base unit 24 which, in the embodiment illustrated, includes a supporting element 26 and two abutment elements 28 and 30. Dividing base unit 24 into three portions merely has the point of simpler production. In particular, abutment elements 28 and 30 can be constructed identically and simply arranged in mirror-image fashion. Alternatively, however, it is also possible to construct base unit 24 in one piece as supporting element 26. Supporting element 26 and abutment elements 28 and 30 can be produced, for example, from stainless steel.

The essentially rigid supporting element 26 performs a number of functions according to the invention. Firstly, it serves to fix two doctor devices, namely a sealing doctor device 32, which is arranged on the inlet side of supporting element 26, in reference to running direction L of base U, and a metering doctor device 34, which is arranged on the outlet side of supporting element 26. Secondly, supporting element 26 serves to deliver medium 12 from distribution pipe 22 into an application chamber 44, which is bounded by doctor devices 32 and 34, an end face 26*a* of supporting element 26 and base U. For this purpose, feed channels 26*b* are formed in supporting element 26, extend to end face 26*a* from an end face 26*c* of supporting element 26 that rests on carrying beam 20 and, in addition, are connected to passages 22*a*, which are formed in distribution pipe 22 or carrying beam 20.

In the embodiment illustrated, both doctor devices 32 and 34 are constructed as roll doctor devices with a doctor rod 36 or 38, which is accommodated in a doctor bed 40 or 42 such that it can be rotated and, if desired, driven in rotation (see arrow P in the case of metering doctor rod 38). Doctor rods 36 and 38 are each smooth (as shown) or profiled. Since doctor devices 32 and 34 are constructed identically to each other in the embodiment illustrated, in the following text the manner of fixing doctor devices 32 and 34 to supporting element 26 will be explained merely using the example of sealing doctor device 32.

In order to fix sealing doctor device 32 to supporting element 26, doctor bed 40 has an attachment 40*a*, which is connected flexibly to a main element 40*b* of doctor bed 40. A force appliance 46, in the present embodiment, is a pressure hose 46 which is supported on abutment element 28. Pressure hose 46 presses attachment 40*a* of doctor bed 40 against a contact face 26*d* on supporting element 26. In order to facilitate the positioning of doctor bed 40 relative to supporting element 26, and in order to reliably prevent any relative movement between doctor bed 40 and supporting element 26 in the operating state of application apparatus 10, additional projections 40*c* provided on attachment 40*a* engage in a form-fitting manner in corresponding depressions 26*e* on contact face 26*d*.

A further pneumatic hose 48, which is likewise supported on abutment element 28, acts on doctor bed 40 in the region of main part 40*b* of the latter. By use of pneumatic hose 48, due to the flexible connection between main part 40*b* and attachment 40*a* of doctor bed 40 when doctor bed 40 is fixed to supporting element 26, the setting of doctor rod 36 against base U can be varied. In this connection, it goes without saying that the flexibility of the connection between attachment 40*a* and main part 40*b* of doctor bed 40 can be provided both by suitable material selection and also by suitable constructional design of doctor bed 40.

Figure 2:
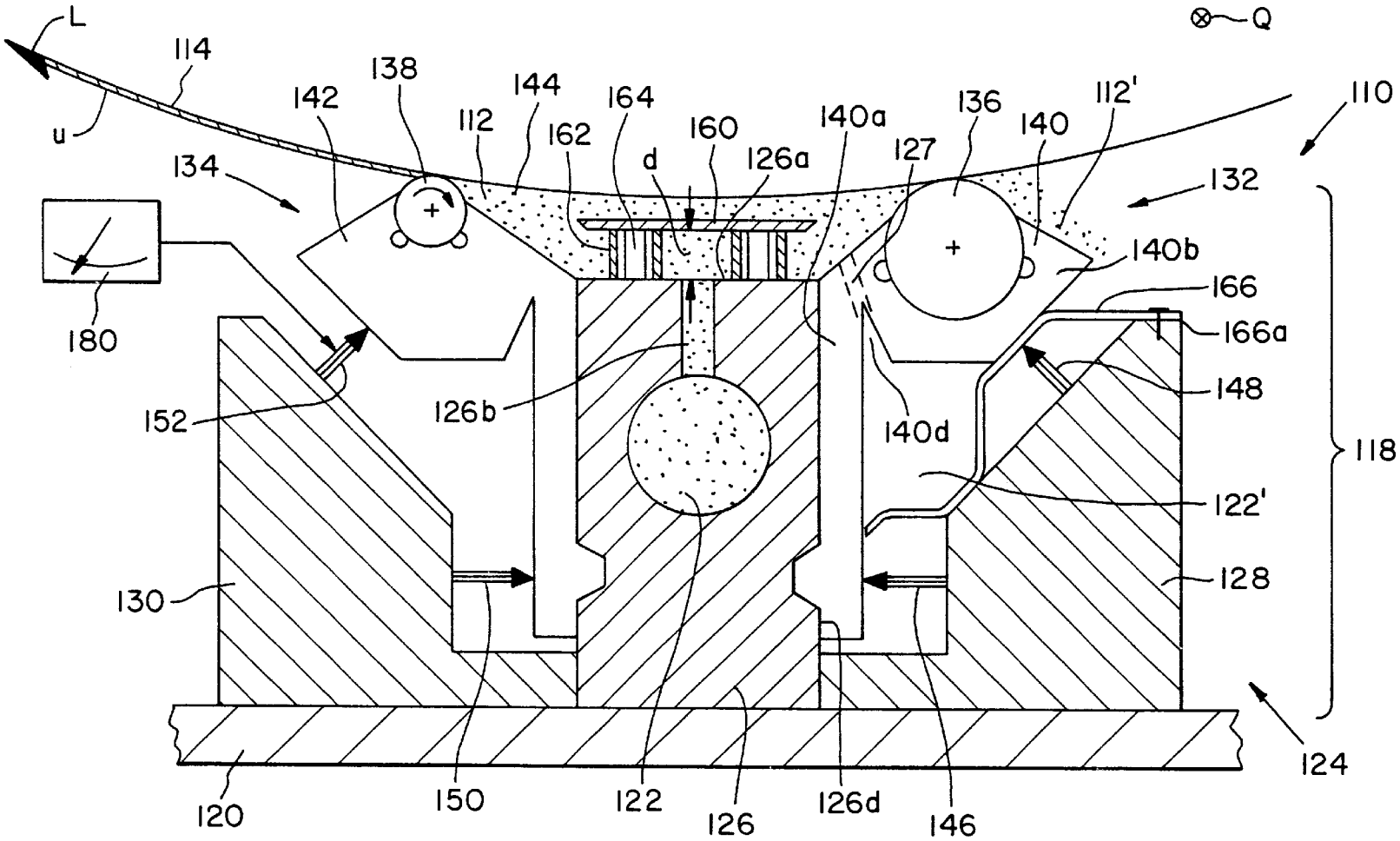
FIGS. 2 and 3 are schematic, sectional illustrations similar to FIG. 1 of further embodiments of an application apparatus according to the invention.

As already mentioned above, doctor device 34 is fixed to supporting element 26 by a pneumatic hose 50 in the same way as has been explained above for sealing doctor device 32. Furthermore, metering doctor device 34 is also assigned a further pneumatic hose 52, which serves to exert an influence on the setting of metering doctor rod 38 against base U. While sealing doctor rod 36 merely has the task of preventing the ingress of air into application chamber 44, in particular of air which is carried along in the form of an air boundary layer (indicated dashed in FIG. 1) by base U on its surface, metering doctor rod 38 is used for metering medium 12, which leaves application chamber 44 in the form of application layer 14, and thus for setting the magnitude of the coat weight of application layer 14. It therefore goes without saying that the setting of metering doctor rod 38 against moving base U must be capable of being varied considerably more finely by pneumatic hose 52 than the setting of sealing doctor rod 36 by pneumatic hose 48. This is indicated in FIG. 2 by a control unit 180.

On account of the essentially rigid construction of supporting unit 26, in the embodiment illustrated in FIG. 1, doctor devices 32 and 34 are kept at a predetermined distance from each other in running direction L of base U. On account of the rigidity of supporting unit 26, this predetermined distance is in this case, in turn, essentially independent of the quantity of medium 12 fed to application chamber 44 per unit time, the pressure prevailing in application chamber 44 and the respective setting of doctor devices 32, 33 against base U. Furthermore, essentially rigid supporting unit 26 ensures a defined arrangement of doctor devices 32 and 34 in transverse direction Q of base U as well. Overall, in this way the conditions prevailing in application chamber 44 and medium feed channels 26*b* can be reproduced so reliably that the excess quantity which leaves application chamber 44 past sealing doctor device 32 can be reduced considerably, as compared with the prior art, and nevertheless a high-quality application layer 14 can be obtained. As a result of reducing the excess quantity, the circulated quantity of medium 12 can be reduced, and thus the delivery pump assigned to medium feed 12 can be designed to have a correspondingly lower performance.

In addition, doctor devices 32 and 34 are provided not only as separately constructed subassemblies but also as subassemblies which can be driven independently of each other, so that a change to the setting of one of two doctor devices 32 and 34 against base U by one of force appliances 48 or 52 has no direct back-effect on the setting of the respective other doctor device 32, 34 against base U. This simplifies in particular the control or regulation of the setting of metering doctor device 34, which has a decisive influence on the coat weight and the quality of the resulting application.

Moreover, doctor devices 32 and 34 are arranged on a supporting element 26 or base unit 24, which is constructed separately from carrying beam 20. But this means carrying beam 20, which as a solid part is difficult to handle and to machine, needs to have only the fixing points for entire application subassembly 18. As will be explained in more detail below using further embodiments, not only does this permit the easy conversion of application apparatus 10 from one design type to another, but it also permits, for example in the event of wear, the rapid replacement of a worn application subassembly 18 by a new application subassembly 18 prepared at an equipment workplace. Of course, because of the fixing of doctor devices 32 and 34 to supporting element 26 by force appliances 46 and 50, the rapid replacement of one or both of doctor devices 32 and 34 is also possible.

A further embodiment of an application apparatus 10 according to the invention is illustrated in FIG. 2. This embodiment essentially corresponds to the embodiment according to FIG. 1. For this reason, in FIG. 2 similar parts are provided with the same reference symbols as in FIG. 1, but increased by the number 100. In addition, the application apparatus 110 according to FIG. 2 will be described below only to the extent to which it differs from the embodiment according to FIG. 1, to whose description reference is hereby expressly otherwise made.

A first difference between application apparatus 110 according to FIG. 2 and application apparatus 10 according to FIG. 1 is that metering doctor rod 138 of metering doctor device 134 has a smaller diameter than sealing doctor rod 136 of sealing doctor device 132. The reason for this is based on the fact that, in this case, medium 112 is fed to application chamber 144 in excess, so that the volume flow leaving application chamber 144 past seating doctor rod 136 is greater than the volume flow leaving application chamber 144 past metering doctor rod 138 as application layer 114.

Furthermore, it is pointed out that doctor beds 140 and 142 essentially have the same shape, in particular in the area of their connection to supporting element 126 and to the point of action for force appliances 146, 148, 150 and 152 (which are illustrated purely schematically as arrows in FIG. 2). This makes it possible to fit one and the same supporting element 126 or one and the same base unit 124 supplemented by abutment elements 128 and 130 with doctor rods 136 and 138 of any desired diameter, provided only that doctor beds 140 and 142 for doctor rods 136 and 138 are of identical construction with regard to the above-mentioned contact areas, matching the predefined design conditions of remaining application subassembly 118.

In relation to doctor beds 140 and 142, it should further be added that the flexibility of the connection of attachment 140*a* to main part 140*b* is assisted by a notch 140*d*.

Finally, the fitting of doctor beds 140 and 142 in supporting element 126 differs from the corresponding type of fitting in the exemplary embodiment according to FIG. 1. To be specific, contact face 126*d* in the region of the fitting of application subassembly 118 to carrying beam 120 runs essentially orthogonally to the surface of the latter.

A further difference between application apparatus 110 according to FIG. 2 and the application apparatus 10 according to FIG. 1 is that, in the area of the opening of the mouth of feed channels 126*b* into application chamber 144, there is arranged a baffle plate 160, which has a predetermined distance d from end face 126*a* of supporting element 126. For this purpose, baffle plate 160 can be fixed to supporting element 126 for example by bolts 164, with the interposition of spacers 162. Baffle plate 160 prevents medium 112 emerging from feed channels 126*b* from coming directly into contact with base U. Instead, medium 112 emerging from feed channels 126*b* is deflected both in running direction L and in transverse direction Q of base U. This leads to a more uniform distribution of medium 112 in transverse direction Q, and thus results in a more uniform coating application. That is to say, a more uniform thickness of application layer 114 in running direction L and in transverse direction Q of base U is produced.

By loosening bolts 164 and replacing spacers 162, it is possible to adapt distance d of baffle plate 160 from end face 126*a* of supporting element 126 to the operating conditions in any desired way, for example, the viscosity of medium 112, the quantity of medium 112 fed to application chamber 144 per unit time, the diameter of doctor rods 136 and 138 and the like. In a similar way, the shape of baffle plate 160 can be chosen in a suitable way to match it to the operating conditions.

A further difference is that distribution pipe 122 in application apparatus 110 according to FIG. 2 is formed in supporting element 126 and not in carrying beam 120. This is advantageous in particular in the case of application apparatus 110 with a low operating width and/or in the case of application apparatus 110 with which only a low coat weight is applied to base U. Furthermore, in this way the construction of carrying beam 120 is simplified.

Finally, application apparatus 110 according to FIG. 2 differs from the embodiment according to FIG. 1 in that, in the area of sealing doctor device 132, between force appliance 148 for exerting an influence on the setting of sealing doctor rod 136 against base U and doctor bed 140, there is arranged a covering element 166 which, for example, is fixed to abutment element 128 at 166*a*. Covering element 166, which can be produced from plastic, for example, has the task of protecting force appliance 148 and also force appliance 146 against contamination by medium 112' which leaves application chamber 144 past sealing doctor device 132 in the direction opposite to running direction L of base U. Such a countercurrent of medium 112' can be desirable, for example, in order to be able to prevent the ingress of air into application chamber 144 still more reliably. It should further be noted that covering element 166 is constructed flexibly and/or fixed to abutment element 128, both in such a way that it does not significantly impede the adjustment of sealing doctor device 132 by force appliance 148.

Although this is not illustrated in FIG. 2, it is of course also possible for a corresponding covering element 166 to be provided in the area of metering doctor device 134 and to protect force appliances 152 and 150 against splashes of medium 112, such as are possibly formed downstream of metering doctor device 134 in running direction L.

In addition or as an alternative to feed channels 126b running through supporting element 126, feed channels 127 can also be provided, which pass through a doctor bed 140 or 142 in one of doctor devices 132 and 134. In FIG. 2, such feed channels 127 are shown dashed only for doctor device 132, for clarity of illustration. Distribution channel 122' feeding feed channels 127 can be formed between doctor bed 140 and abutment element 128 or, as in the embodiment illustrated, between doctor bed 140 and covering element 166.

Figure 3:
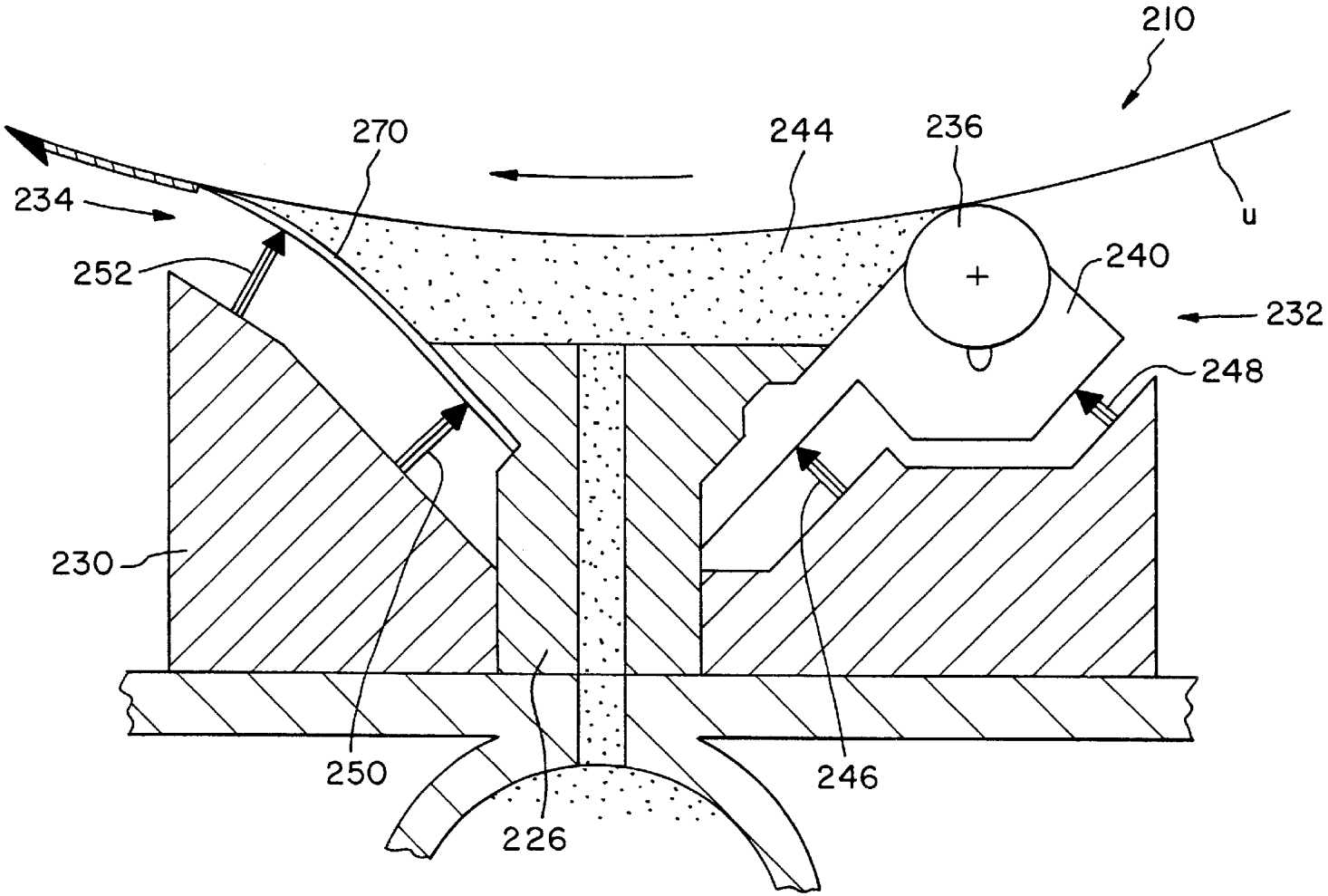

FIG. 3 illustrates a further application apparatus according to the invention, which essentially corresponds to the two application apparatuses described above. Therefore, in FIG. 3 analogous parts are provided with the same reference symbols as in FIG. 1, but increased by the number 200. Furthermore, the embodiment according to FIG. 3 is described below only to the extent to which it differs from the embodiments according to FIGS. 1 and 2, to whose description reference is hereby otherwise expressly made.

The single significant difference between application apparatus 210 and application apparatus 10 according to FIG. 1 and 110 according to FIG. 2 is that metering doctor device 234 does not include a doctor rod accommodated in a doctor bed but a doctor blade 270. In this case, supporting element 226, abutment element 230 and force appliance 250 perform the function of a blade holder, while force appliance 252 serves to set doctor blade 270 against running base U. Otherwise, the embodiment according to FIG. 3, in particular that which refers to the construction of sealing doctor device 232 with a sealing doctor rod 236 and a doctor bed 240 and to their fixing and driving by force appliances 246 and 248 and the like, corresponds to the embodiments according to FIGS. 1 and 2.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An application apparatus for applying a liquid or pasty medium to a moving base, the moving base being a surface of a fiber material web in a case of direct application and a surface of a transfer element for transferring the medium to the material web in a case of indirect application, said application apparatus having an inlet side and an outlet side with respect to a direction of movement of the moving base, said application apparatus comprising:

a carrying beam;

an essentially rigid supporting unit provided on said carrying beam including two supporting unit depressions;

a sealing doctor device positioned at said inlet side of said application apparatus, said sealing doctor device including at least one sealing doctor device projection engaging one of said supporting unit depressions, said sealing doctor device being thereby fixedly positionable to said supporting unit, said sealing doctor device being controllably movable relative to said supporting unit; and a metering doctor device positioned at said outlet side of said application apparatus, said metering doctor device including at least one metering doctor device projection engaging the other one of, said supporting unit depressions, said metering doctor device being thereby fixedly positionable to said supporting unit, said sealing doctor device and said metering doctor device defining an application chamber therebetween, said metering doctor device being controllably movable relative to said supporting unit.

2. The application apparatus of claim 1, wherein said supporting unit includes at least one feed channel formed therein, said supporting unit further comprising a distribution pipe for carrying the medium, each said feed channel being fluidly coupled with said distribution pipe and said application chamber, said each feed channel being configured for feeding the medium from said distribution pipe to said application chamber.

3. The application apparatus of claim 2, wherein said distribution pipe is located within said supporting unit.

4. The application apparatus of claim 1, wherein at least one of said sealing doctoring device and said metering doctoring device is adapted to be fixedly attached to said supporting unit in a form-fitting manner.

5. The application apparatus of claim 1, wherein a force appliance is attached to said supporting unit, said force appliance fixing at least one of said sealing doctor device and said metering doctor device to said supporting unit.

6. The application apparatus of claim 5, herein said force appliance is supported on one of said supporting unit and a part connected to said supporting unit.

7. The application apparatus of claim 5, wherein said force appliance is configured for influencing a setting of said at least one of said sealing doctor device and said metering doctor device against the moving base.

8. The application apparatus of claim 7, wherein said force appliance is supported on one of said supporting unit and a part connected to said supporting unit.

9. The application apparatus of claim 5, wherein said force appliance is operated at least one of hydraulically, pneumatically, hydropneumatically, electrically, magnetically, electrochemically, and by electric motor.

10. The application apparatus of claim 1, wherein said sealing doctor device is configured to have a setting against the moving base, the setting being adjustable without closed-loop control.

11. The application apparatus of claim 1, wherein said metering doctor device is configured to have a setting against the moving base, the setting being controllable.

12. The application apparatus of claim 1, wherein at least one of said sealing doctor device and said metering doctor device is comprised of a doctor rod.

13. The application apparatus of claim 12, wherein said sealing doctor device and said metering doctor device each are comprised of a doctor rod, each said doctor rod having a surface that is one of smooth and profiled.

14. The application apparatus of claim 13, wherein each said doctor rod has a smooth surface.

15. The application apparatus of claim 1, wherein said sealing doctor device and said metering doctor device are capable of being fixed to said supporting unit independently of each other.

16. The application apparatus of claim 1, wherein said supporting unit is a unit constructed separately from said carrying beam.

17. The application apparatus of claim 1, wherein the medium applied by said application apparatus has a given coat weight, said sealing doctor device and said metering doctor device being configured for varying the coat weight by changing a loading relationship therebetween.

18. The application apparatus of claim 1, wherein a loading of said sealing doctor device is capable of being controlled one of directly and indirectly based upon a pressure prevailing in said application chamber.

19. The application apparatus of claim 1, wherein said metering doctor device and said sealing doctor device are capable of movement independent of each other.

20. An application apparatus for applying a liquid or pasty medium to a moving base, the moving base being a surface of a fiber material web in a case of direct application and a surface of a transfer element for transferring the medium to the material web in a case of indirect application, said application apparatus having an inlet side and an outlet side with respect to a direction of movement of the moving base, said application apparatus comprising:

a carrying beam;

an essentially rigid supporting unit provided on said carrying beam;

a sealing doctor device positioned at said inlet side of said application apparatus, said sealing doctor device being fixedly attached to said supporting unit; and a metering doctor device positioned at said outlet side of said application apparatus, said metering doctor device being fixedly attached to said supporting unit, said sealing doctor device and said metering doctor device defining an application chamber therebetween, at least one of said sealing doctor device and said metering doctor device including a distribution channel and at least one feed channel formed therein, each said feed channel fluidly connecting said distribution channel with said application chamber, each said feed channel being configured for feeding the medium from said distribution channel to said application chamber.

21. The application apparatus of claim 20, wherein each said feed channel has an end which opens into said application chamber, each said opening end defining an outlet opening, said at least one of said sealing doctor device and said metering doctor device thereby having at least one outlet opening, and wherein said application apparatus further comprises at least one baffle plate arranged proximate to at least one of said at least one outlet openings.

22. The application apparatus of claim 21, wherein at least one of a shape of said at least one baffle plate and a distance between said at least one baffle plate and said at least one outlet opening is chosen on the basis of operating conditions.

23. The application apparatus of claim 21, wherein each said baffle plate is detachably fixed to said supporting unit.

24. An application apparatus for applying a liquid or pasty medium to a moving base, the moving base being a surface of a fiber material web in a case of direct application and a surface of a transfer element for transferring the medium to the material web in a case of indirect application, said application apparatus having an inlet side and an outlet side with respect to a direction of movement of the moving base, said application apparatus comprising:

a carrying beam;

an essentially rigid supporting unit provided on said carrying beam;

a sealing doctor device positioned at said inlet side of said application apparatus, said sealing doctor device being fixedly attached to said supporting unit;

a metering doctor device positioned at said outlet side of said application apparatus, said metering doctor device being fixedly attached to said supporting unit, said sealing doctor device and said metering doctor device defining an application chamber therebetween;

a force appliance attached to said supporting unit, said force appliance fixing at least one of said sealing doctor device and said metering doctor device to said supporting unit, each said at least one of said sealing doctor device and said metering doctor device having at least one force appliance assigned thereto; and a flat covering element provided between said at least one of said sealing doctor device and said metering doctor device and said at least one force appliance assigned thereto.

25. An application apparatus for applying a liquid or pasty medium to a moving base, the moving base being a surface of a fiber material web in a case of direct application and a surface of a transfer element for transferring the medium to the material web in a case of indirect application, said application apparatus having an inlet side and an outlet side with respect to a direction of movement of the moving base, said application apparatus comprising:

a carrying beam;

an essentially rigid supporting unit provided on said carrying beam including two supporting unit depressions;

a sealing doctor device positioned at said inlet side of said application apparatus, said sealing doctor device including at least one sealing doctor device projection engaging one of said supporting unit depressions, said sealing doctor device being thereby fixedly positionable to said supporting unit, said sealing doctor device being controllably movable relative to said supporting unit; and a metering doctor device positioned at said outlet side of said application apparatus, said metering doctor device including at least one metering doctor device projection engaging the other one of said supporting unit depressions, said metering doctor device being thereby fixedly positionable to said supporting unit, said sealing doctor device and said metering doctor device defining an application chamber therebetween, said metering doctor device being controllably movable relative to said supporting unit, at least one of said sealing doctor device and said metering doctor device being comprised of a doctor rod, said doctor rod being rotatably driven.

26. An application apparatus for applying a liquid or pasty medium to a moving base, the moving base being a surface of a fiber material web in a case of direct application and a surface of a transfer element for transferring the medium to the material web in a case of indirect application, said application apparatus having an inlet side and an outlet side with respect to a direction of movement of the moving base, said application apparatus comprising:

a carrying beam;

an essentially rigid supporting unit provided on said carrying beam;

a sealing doctor device positioned at said inlet side of said application apparatus, said sealing doctor device being fixedly attached to said supporting unit; and a metering doctor device positioned at said outlet side of said application apparatus, said metering doctor device being fixedly attached to said supporting unit, said sealing doctor device and said metering doctor device defining an application chamber therebetween, said sealing doctor device and said metering doctor device each being comprised of a doctor rod, said sealing doctor rod having a first diameter and said metering doctor rod having a second diameter, said first diameter being one of essentially equal to and greater than said second diameter.

27. The application apparatus of claim 26, wherein said first diameter is greater than said second diameter.

28. An application apparatus for applying a liquid or pasty medium to a moving base, the moving base being a surface of a fiber material web in a case of direct application and a surface of a transfer element for transferring the medium to the material web in a case of indirect application, said application apparatus having an inlet side and an outlet side with respect to a direction of movement of the moving base, said application apparatus comprising:

a carrying beam;

an essentially rigid supporting unit provided on said carrying beam including two supporting unit depressions;

a sealing doctor device positioned at said inlet side of said application apparatus, said sealing doctor device including at least one sealing doctor device projection engaging one of said supporting unit depressions, said sealing doctor device being thereby fixedly positionable to said supporting unit, said sealing doctor device being controllably movable relative to said supporting unit; and a metering doctor device positioned at said outlet side of said application apparatus, said metering doctor device being comprised of a doctor blade wherein an abutement element and force appliances in combination acting upon said doctor blade thereby resulting in said doctor blade engaging the other one of said supporting unit depressions, said metering doctor device being thereby fixedly positionable to said supporting unit, said sealing doctor device and said metering doctor device defining an application chamber therebetween, said metering doctor device being controllably movable relative to said supporting unit.

29. An application apparatus for applying a liquid or pasty medium to a moving base, the moving base being a surface of a fiber material web in a case of direct application and a surface of a transfer element for transferring the medium to the material web in a case of indirect application, said application apparatus having an inlet side and an outlet side with respect to a direction of movement of the moving base, said application apparatus comprising:

a carrying beam;

an essentially rigid supporting unit provided on said carrying beam including two supporting unit depressions;

a sealing doctor device positioned at said inlet side of said application apparatus, said sealing doctor device including at least one sealing doctor device projection engaging one, said supporting unit depressions, said sealing doctor device being thereby fixedly positionable to said supporting unit, said sealing doctor device being controllably movable relative to said supporting unit;

a metering doctor device positioned at said outlet side of said application apparatus, said metering doctor device including at least one metering doctor device projection engaging the other one of said supporting unit depressions, said metering doctor device being thereby fixedly positionable to said supporting unit, said sealing doctor device and said metering doctor device defining an application chamber therebetween, said metering doctor device being controllably movable relative to said supporting unit; and a force appliance attached to said supporting unit, said force appliance fixing at least one of said sealing doctor device and said metering doctor device to said supporting unit, at least one of said sealing doctor device and said metering doctor device having a plurality of said force appliances assigned thereto, said plurality of said force appliances being arranged adjacently in a direction transverse to the base, said plurality of said force appliances being configured for being at least one of driven and controlled independently of one another.

30. The application apparatus of claim 29, wherein said metering doctor device has a plurality of force appliances assigned thereto.

* * * * *

UNITED STATES PATENT AND TRADEMARK OFFICE

CERTIFICATE OF CORRECTION

PATENT NO. : 6,579,368 B1
DATED : June 17, 2003
INVENTOR(S) : Kohl et al.

It is certified that error appears in the above-identified patent and that said Letters Patent is hereby corrected as shown below:

Column 2,
Line 31, please delete “rigidity [] of” , and substitute therefore -- rigidity of --.

Column 14,
Line 21, please delete “one,”, and substitute therefore -- one of --.

Signed and Sealed this

Third Day of August, 2004

JON W. DUDAS
*Acting Director of the United States Patent and Trademark Office*